US012791289B1

(12) United States Patent
Lau

(10) Patent No.: US 12,791,289 B1
(45) Date of Patent: Nov. 10, 2026

(54) ADJUSTABLE ACCESSORY MOUNT

(71) Applicant: Shui Lau, Lewis Center, OH (US)

(72) Inventor: Shui Lau, Lewis Center, OH (US)

( * ) Notice: Subject to any disclaimer, the term of this patent is extended or adjusted under 35 U.S.C. 154(b) by 0 days.

(21) Appl. No.: 19/368,461

(22) Filed: Oct. 24, 2025

(51) Int. Cl.
*F41G 11/00* (2006.01)

(52) U.S. Cl.
CPC ..... *F41G 11/003* (2013.01)

(58) Field of Classification Search
CPC ... F41G 1/22; F41G 1/387; F41G 1/24; F41G 1/26; F41G 1/28; F41G 1/16
USPC ..... 42/125–127, 135–139, 146, 148
See application file for complete search history.

(56) References Cited

U.S. PATENT DOCUMENTS

| | | | | |
|---|---|---|---|---|
| 8,312,668 | B2 * | 11/2012 | Kincel | F41C 27/00 42/114 |
| 8,839,575 | B1 * | 9/2014 | Liu | F24S 25/33 52/173.3 |
| 2010/0122485 | A1 * | 5/2010 | Kincel | F41G 11/004 42/146 |
| 2019/0078730 | A1 * | 3/2019 | Braun | B60R 1/06 |
| 2019/0273460 | A1 * | 9/2019 | Kovacs | F24S 25/35 |

OTHER PUBLICATIONS https://www.valhallatactical.com/baldr-hybrid-kit/.
https://www.instagram.com/reel/BzGwTjbgHDG/.
https://www.bobroengineering.com/Flashlight-Mounts_c_29.html.
https://www.surefire.com/scout-light-pro/.
https://www.meteoriteconcepts.com/products/pivot-adapter.
https://www.amazon.com/Monstrum-Adjustable-Pivoting-Compatible-Streamlight/dp/BOCGYDVHRJ?th=1.

* cited by examiner

*Primary Examiner* — John Cooper
(74) *Attorney, Agent, or Firm* — Shaddock Law Group, PC

(57) ABSTRACT

An adjustable accessory mount, including an accessory element having an arcuate attachment leg extending from the accessory element body; and a mount element having an arcuate mount recess formed so as to extend into at least a portion of the mount element body, wherein the arcuate mount recess is formed so as to matingly correspond to the arcuate attachment leg such that at least a portion of the arcuate attachment leg may be repeatably, slidably positioned within at least a portion of the arcuate mount recess, and wherein if a compressional force is applied to the mount element body, proximate the arcuate mount recess, one or more portions of the arcuate mount recess are at least partially compressed against one or more outer surfaces of the arcuate attachment leg to limit movement of the arcuate attachment leg relative to the arcuate mount recess.

20 Claims, 14 Drawing Sheets

ADJUSTABLE ACCESSORY MOUNT

CROSS-REFERENCE TO RELATED APPLICATIONS

Not Applicable.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

NOTICE OF COPYRIGHTED MATERIAL

The disclosure of this patent document contains material that is subject to copyright protection. The copyright owner has no objection to the reproduction by anyone of the patent document or the patent disclosure, as it appears in the Patent and Trademark Office patent file or records, but otherwise reserves all copyright rights whatsoever. Unless otherwise noted, all trademarks and service marks identified herein are owned by the applicant.

BACKGROUND OF THE DISCLOSURE

1. Field of the Disclosure

The present disclosure relates generally to the field of accessory mounts and is particularly directed to an adjustable accessory mount for a firearm.

2. Description of Related Art

It is known to attach or mount various accessories, such as, for example, lights or other illuminating devices, laser pointers or designators, etc. to rails or other portions of a firearm.

For example, is down to mount an Advanced Target Pointer Illuminator Aiming Laser (ATPIAL AN/PEQ-15 or a "PEQ-15") or a Dual Beam Aiming Laser (DBAL-A2 or DBAL-A3) to a firearm accessory rail, typically at a 12 o'clock position.

Any discussion of documents, acts, materials, devices, articles, or the like, which has been included in the present specification is not to be taken as an admission that any or all of these matters form part of the prior art base or were common general knowledge in the field relevant to the present disclosure as it existed before the priority date of each claim of this application.

BRIEF SUMMARY AND OBJECTS OF THE DISCLOSURE

In some instances, it may be desirable or advantageous to also attach or mount an additional accessory, such as, for example, a visible light illuminating device or flashlight, in addition to the aiming laser. Unfortunately, known accessory mounts lack a degree of adjustability and can cause mounted accessories to interfere with one another. For example, a flashlight may be mounted in such a way that the head or lens assembly partially or fully blocks a laser or other illuminating device of an attached or mounted PEQ-15 or DBAL-A3.

The adjustable accessory mount of the present disclosure provides an accessory element that is arcuately adjustable or is able to be arcuately rotated or turned, relative to a mount element in a way that creates or follows a curved or arched path.

These and other disadvantages of the prior art are overcome with the present disclosure, wherein the adjustable accessory mount includes at least some of an accessory element having an accessory element body, an intermediate portion extending from a lower portion of the accessory element body, and an arcuate attachment leg extending from the intermediate portion, wherein the arcuate attachment leg is formed of an arced, curved, bowed, bent, or semicircular portion, and wherein one or more attachment leg apertures are formed through the arcuate attachment leg; and a mount element having a mount element body, wherein an arcuate mount recess is formed so as to extend into at least a portion of the mount element body, wherein the arcuate mount recess is formed of an arced, curved, bowed, bent, or semicircular recess extending from an upper portion of the mount element body, wherein the arcuate mount recess is formed so as to matingly correspond to the arcuate attachment leg such that at least a portion of the arcuate attachment leg may be repeatably, slidably positioned within at least a portion of the arcuate mount recess, wherein one or more primary apertures are formed through the mount element body and one or more secondary apertures are formed through the mount element body, wherein each of the one or more primary apertures is formed through a first side of the mount element body to extend to the arcuate mount recess, wherein each of the one or more secondary apertures is formed through a second side of the mount element body to extend to the arcuate mount recess, wherein each of the one or more primary apertures is aligned with a corresponding one of the one or more secondary apertures, wherein the arcuate attachment leg of the accessory element is positionable at least partially within a portion of the arcuate mount recess of the mount element such that each of the attachment leg apertures is aligned between a corresponding one of the primary apertures and one of the secondary apertures, wherein a discrete fastening element is positionable at least partially through one of the primary apertures, a corresponding one of the attachment leg apertures, and a corresponding one of the secondary apertures, and wherein if a compressional force is applied to the first side of the mount element body and the second side of the mount element body, proximate the arcuate mount recess, one or more portions of the arcuate mount recess are at least partially compressed against one or more outer surfaces of the arcuate attachment leg to limit or restrict movement of the arcuate attachment leg relative to the arcuate mount recess.

In various exemplary, non-limiting embodiments, the accessory element body extends, along a longitudinal axis of the accessory element, between a first terminal end of the accessory element body and a second terminal end of the accessory element body.

In various exemplary, non-limiting embodiments, a coupling portion is formed in a portion of the first terminal end of the accessory element body and a coupling portion is formed in a portion of the second terminal end of the accessory element body.

In various exemplary, non-limiting embodiments, the coupling portion of the first terminal end and the coupling portion of the second terminal end each comprise externally threaded portions or coupling attachments.

In various exemplary, non-limiting embodiments, a first accessory component in the form of a flashlight head assembly is attached or coupled to the first terminal end of the accessory element body and a second accessory component in the form of a flashlight tail assembly is attached for coupled to the second terminal end of the accessory element body.

In various exemplary, non-limiting embodiments, an interior recess is formed partially into or through the accessory element body, extending between the first terminal end of the accessory element body and the second terminal end of the accessory element body.

In various exemplary, non-limiting embodiments, the intermediate portion extends tangentially, radially, or as a centerline extension from the accessory element body.

In various exemplary, non-limiting embodiments, the arcuate attachment leg is at least partially defined by a convex curve or a concave curve.

In various exemplary, non-limiting embodiments, an arc of the arcuate attachment leg is approximately 90°.

In various exemplary, non-limiting embodiments, an arc of the arcuate attachment leg is between approximately 85° and 95°.

In various exemplary, non-limiting embodiments, an arc of the arcuate attachment leg is between approximately 80° and 100°.

In various exemplary, non-limiting embodiments, the attachment leg apertures extend substantially perpendicular to a transverse axis of the accessory element, and wherein the attachment leg apertures are formed of rectangles with rounded or radiused ends.

In various exemplary, non-limiting embodiments, the arcuate mount recess extends between a first terminal end of the mount element a second terminal end of the mount element.

In various exemplary, non-limiting embodiments, the arcuate mount recess is at least partially defined by a convex curve or a concave curve.

In various exemplary, non-limiting embodiments, an arc of the arcuate mount recess is between approximately 80° and 100°.

In various exemplary, non-limiting embodiments, one or more alignment projections extend outward from the second side of the mount element body around at least one or more portions of each of the secondary apertures.

In various exemplary, non-limiting embodiments, the adjustable accessory mount of the present disclosure includes at least some of an accessory element having an accessory element body, an intermediate portion extending from a lower portion of the accessory element body, and an arcuate attachment leg extending from the intermediate portion, and wherein one or more attachment leg apertures are formed through the arcuate attachment leg; and a mount element having a mount element body, wherein an arcuate mount recess is formed so as to extend into at least a portion of the mount element body, wherein the arcuate mount recess is formed so as to matingly correspond to the arcuate attachment leg such that at least a portion of the arcuate attachment leg may be repeatably, slidably positioned within at least a portion of the arcuate mount recess, wherein one or more primary apertures are formed through the mount element body and one or more secondary apertures are formed through the mount element body, wherein each of the one or more primary apertures is formed through a first side of the mount element body to extend to the arcuate mount recess, wherein each of the one or more secondary apertures is formed through a second side of the mount element body to extend to the arcuate mount recess, wherein each of the one or more primary apertures is aligned with a corresponding one of the one or more secondary apertures, wherein the arcuate attachment leg of the accessory element is positionable at least partially within a portion of the arcuate mount recess of the mount element such that each of the attachment leg apertures is aligned between a corresponding one of the primary apertures and one of the secondary apertures, and wherein if a compressional force is applied to the first side of the mount element body and the second side of the mount element body, proximate the arcuate mount recess, one or more portions of the arcuate mount recess are at least partially compressed against one or more outer surfaces of the arcuate attachment leg to limit or restrict movement of the arcuate attachment leg relative to the arcuate mount recess.

In various exemplary, non-limiting embodiments, the adjustable accessory mount of the present disclosure includes at least some of an accessory element having an accessory element body, an arcuate attachment leg extending from a portion of the accessory element body, and wherein one or more attachment leg apertures are formed through the arcuate attachment leg; and a mount element having a mount element body, wherein an arcuate mount recess is formed so as to extend into at least a portion of the mount element body, wherein the arcuate mount recess is formed so as to matingly correspond to the arcuate attachment leg such that at least a portion of the arcuate attachment leg may be repeatably, slidably positioned within at least a portion of the arcuate mount recess, wherein one or more primary apertures are formed through the mount element body and one or more secondary apertures are formed through the mount element body, wherein each of the one or more primary apertures is formed through a first side of the mount element body to extend to the arcuate mount recess, wherein each of the one or more secondary apertures is formed through a second side of the mount element body to extend to the arcuate mount recess, wherein each of the one or more primary apertures is aligned with a corresponding one of the one or more secondary apertures, wherein the arcuate attachment leg of the accessory element is positionable at least partially within a portion of the arcuate mount recess of the mount element such that each of the attachment leg apertures is aligned between a corresponding one of the primary apertures and one of the secondary apertures, and wherein if a compressional force is applied to the first side of the mount element body and the second side of the mount element body, proximate the arcuate mount recess, one or more portions of the arcuate mount recess are at least partially compressed against one or more outer surfaces of the arcuate attachment leg to limit or restrict movement of the arcuate attachment leg relative to the arcuate mount recess.

Accordingly, the present disclosure separately and optionally provides an improved adjustable accessory mount.

The present disclosure separately and optionally provides an adjustable accessory mount that allows an accessory to be attached or coupled to a firearm rail.

The present disclosure separately and optionally provides an adjustable accessory mount that allows an accessory to be adjustably attached or coupled to a firearm rail.

The present disclosure separately and optionally provides an adjustable accessory mount that allows a distance between an accessory and a firearm rail to be easily adjusted.

The present disclosure separately and optionally provides an adjustable accessory mount that can be easily manipulated by a user.

These and other aspects, features, and advantages of the presently disclosed systems, methods, and/or apparatuses are described in or are apparent from the following detailed description of the exemplary, non-limiting embodiments of the presently disclosed systems, methods, and/or apparatuses and the accompanying figures. Other aspects and features of embodiments of the presently disclosed systems, methods, and/or apparatuses will become apparent to those of ordinary skill in the art upon reviewing the following description of specific, exemplary embodiments of the presently disclosed systems, methods, and/or apparatuses in concert with the figures. While features of the presently disclosed systems, methods, and/or apparatuses may be discussed relative to certain embodiments and figures, all embodiments of the presently disclosed systems, methods, and/or apparatuses can include one or more of the features discussed herein. Further, while one or more embodiments may be discussed as having certain advantageous features, one or more of such features may also be used with the various embodiments of the systems, methods, and/or apparatuses discussed herein. In similar fashion, while exemplary embodiments may be discussed below as device, system, or method embodiments, it is to be understood that such exemplary embodiments can be implemented in various devices, systems, and methods of the presently disclosed systems, methods, and/or apparatuses.

Any benefits, advantages, or solutions to problems that are described herein with regard to specific embodiments are not intended to be construed as a critical, required, or essential feature(s) or element(s) of the presently disclosed systems, methods, and/or apparatuses or the claims.

BRIEF DESCRIPTION OF THE DRAWINGS

As required, detailed exemplary embodiments of the present disclosure are disclosed herein; however, it is to be understood that the disclosed embodiments are merely exemplary of the present disclosure that may be embodied in various and alternative forms, within the scope of the present disclosure. The figures are not necessarily to scale; some features may be exaggerated or minimized to illustrate details of particular components. Therefore, specific structural and functional details disclosed herein are not to be interpreted as limiting, but merely as a basis for the claims and as a representative basis for teaching one skilled in the art to employ the present disclosure.

The exemplary embodiments of the present disclosure will be described in detail, with reference to the following figures, wherein like reference numerals refer to like parts throughout the several views, and wherein.

DETAILED DESCRIPTION OF THE DISCLOSURE

Figure 1:
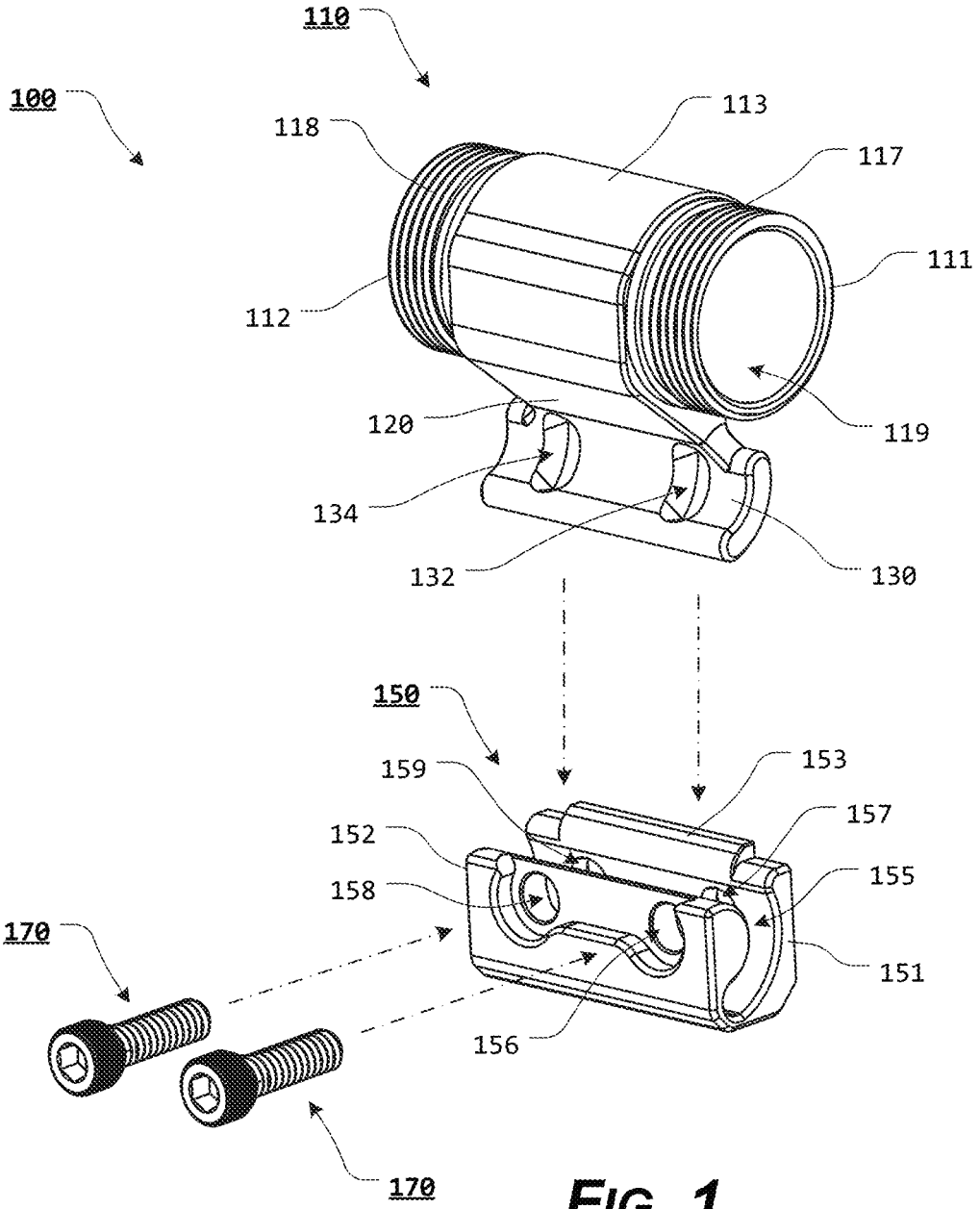
FIG. 1 illustrates an upper, front, left isometric view of certain exemplary components of an exemplary embodiment of an adjustable accessory mount, according to the present disclosure.
Figure 2:
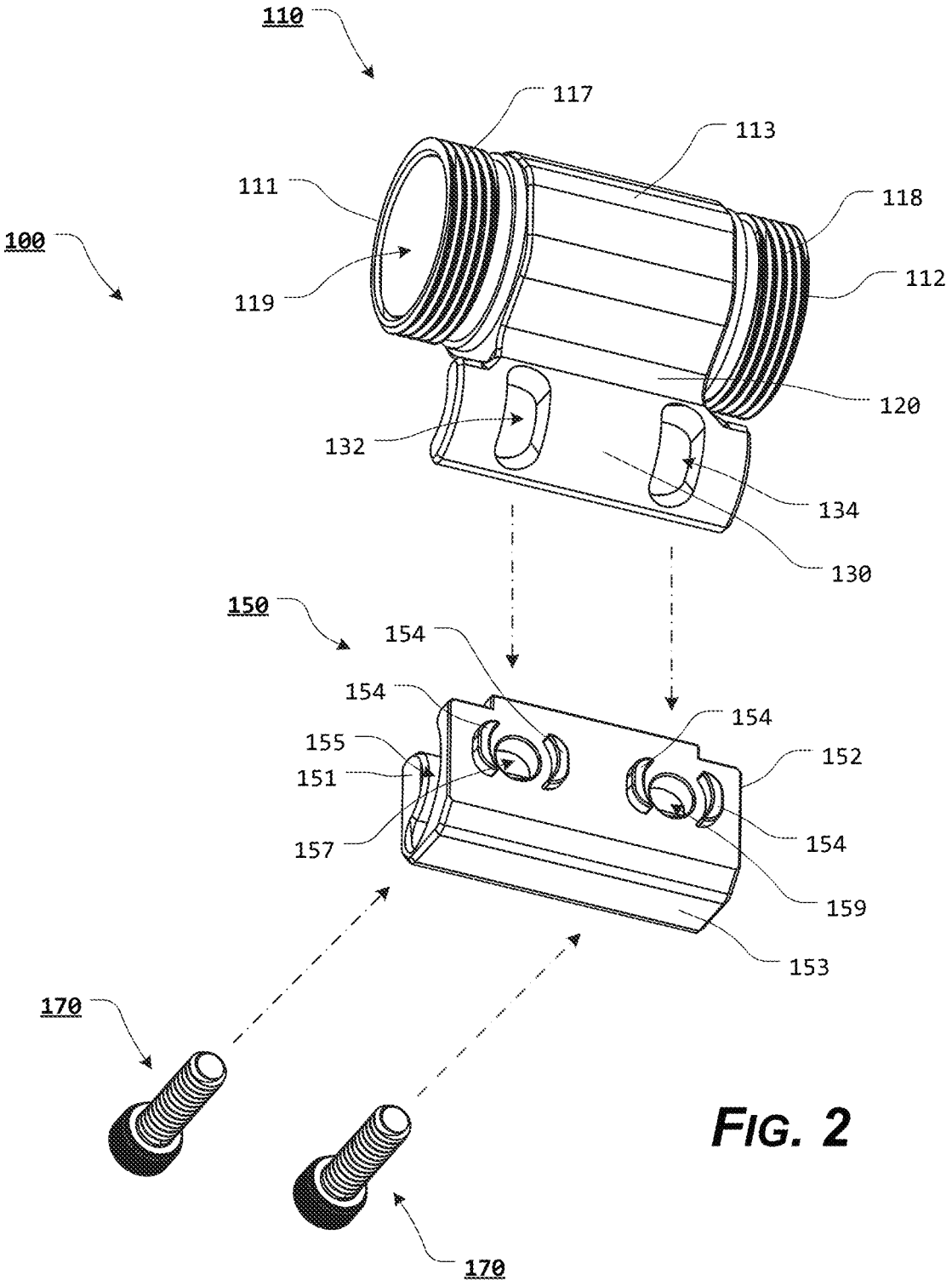
FIG. 2 illustrates a lower front, right isometric view of certain exemplary components of an exemplary embodiment of an adjustable accessory mount, according to the present disclosure.
Figure 3:
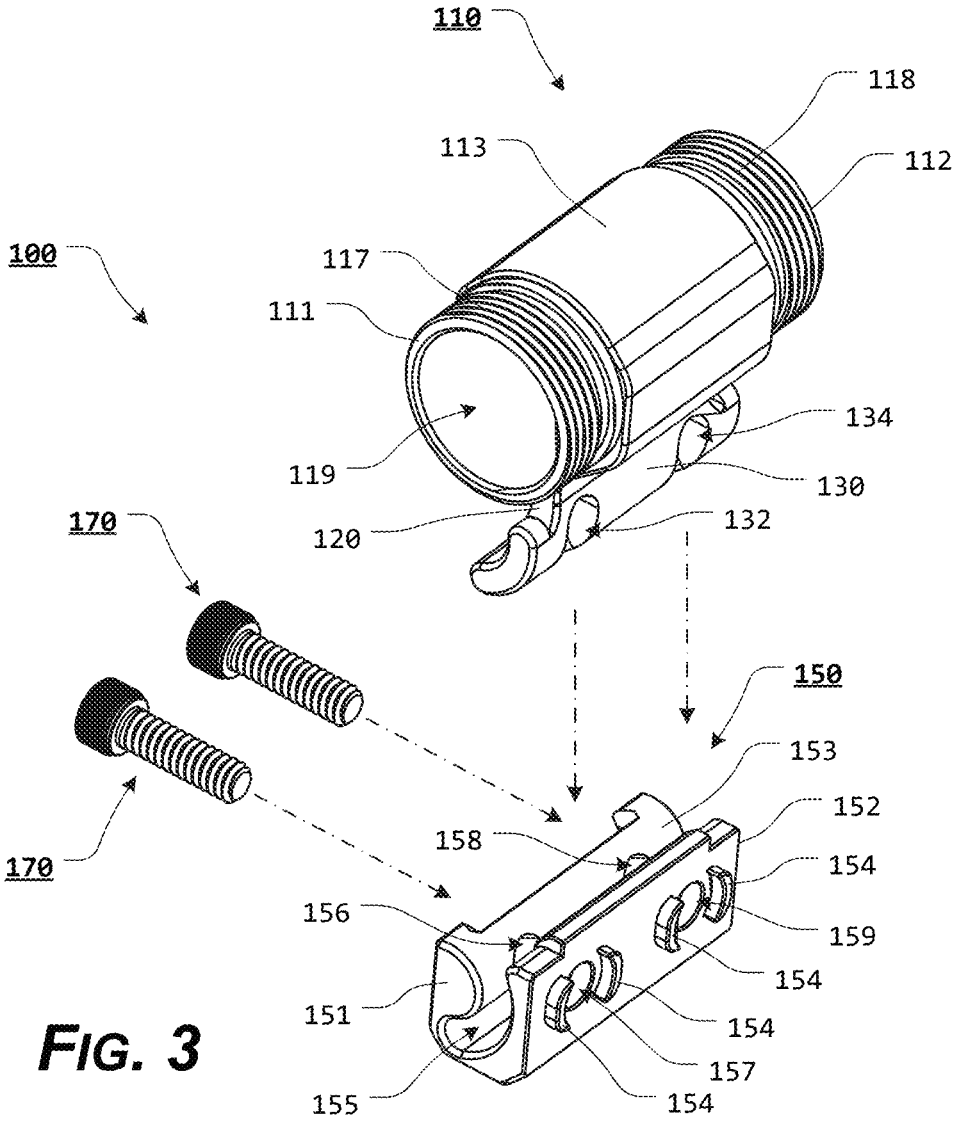
FIG. 3 illustrates an upper, front, left isometric view of certain exemplary components of an exemplary embodiment of an adjustable accessory mount, according to the present disclosure.
Figure 4:
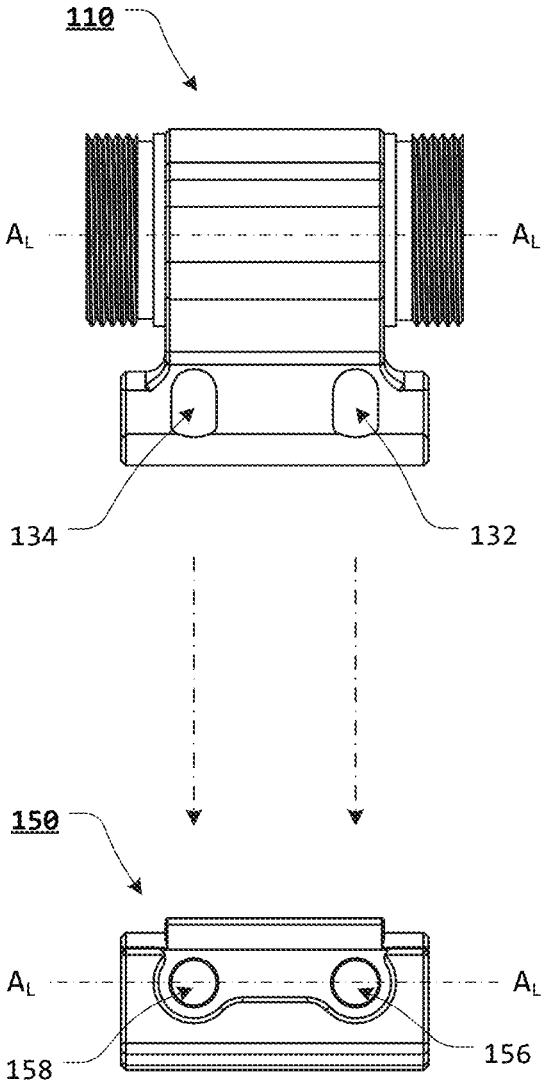
FIG. 4 illustrates a left side view of certain exemplary components of an exemplary embodiment of an adjustable accessory mount, according to the present disclosure.
Figure 5:
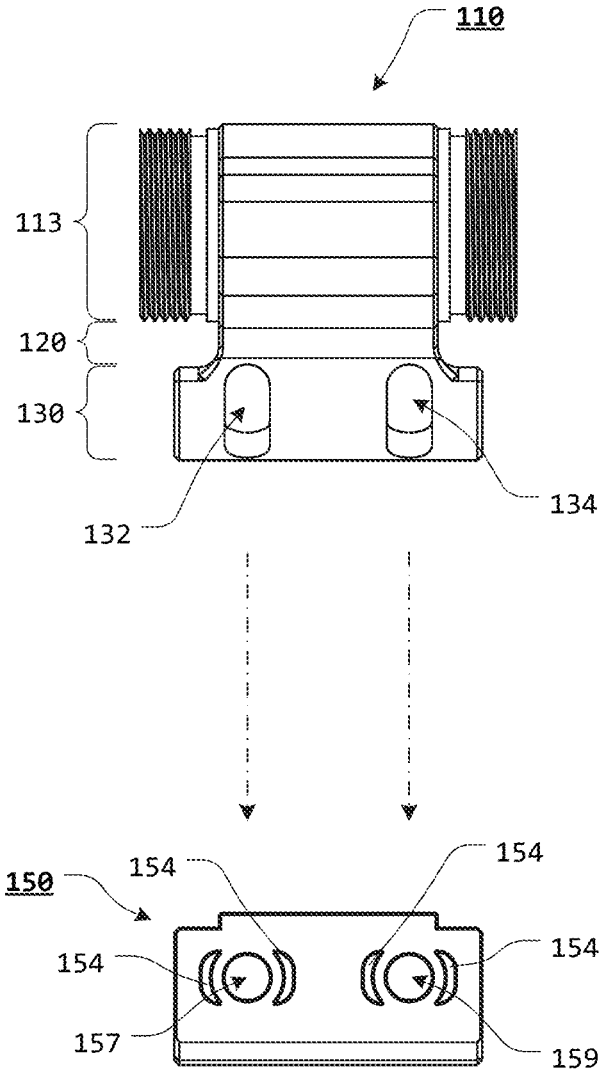
FIG. 5 illustrates a right side view of certain exemplary components of an exemplary embodiment of an adjustable accessory mount, according to the present disclosure.
Figure 6:
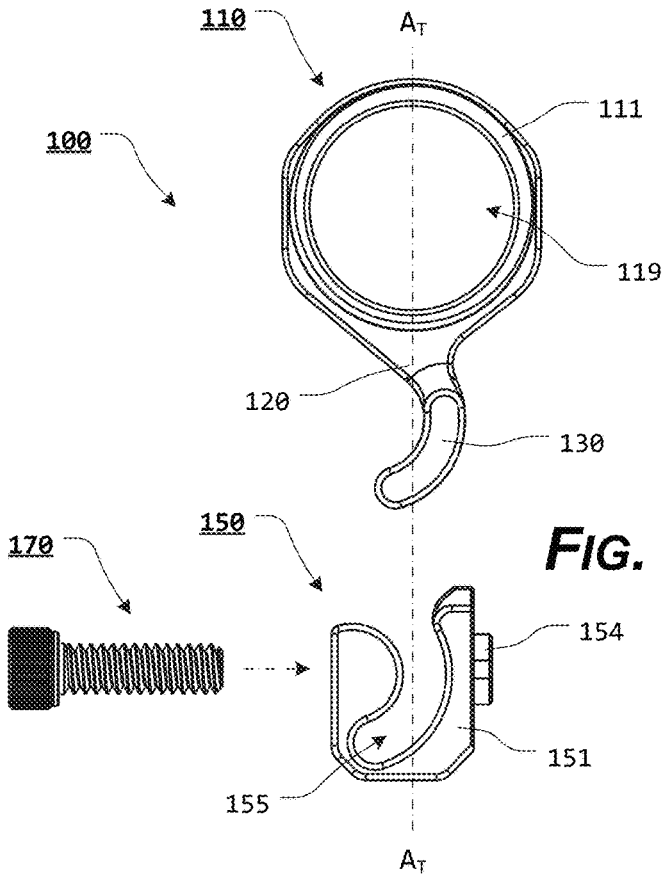
FIG. 6 illustrates a front view of certain exemplary components of an exemplary embodiment of an adjustable accessory mount, according to the present disclosure.
Figure 7:
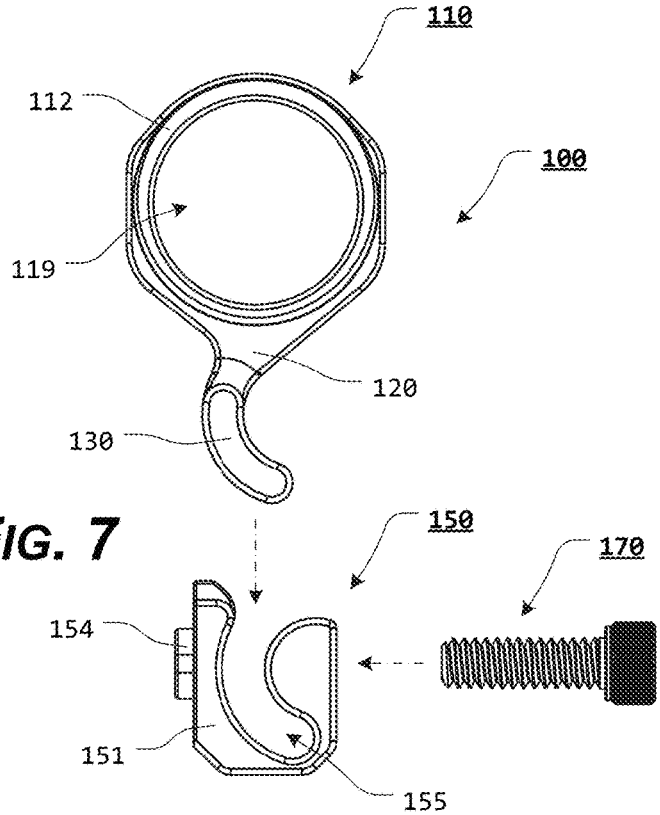
FIG. 7 illustrates a rear view of certain exemplary components of an exemplary embodiment of an adjustable accessory mount, according to the present disclosure.
Figure 8:
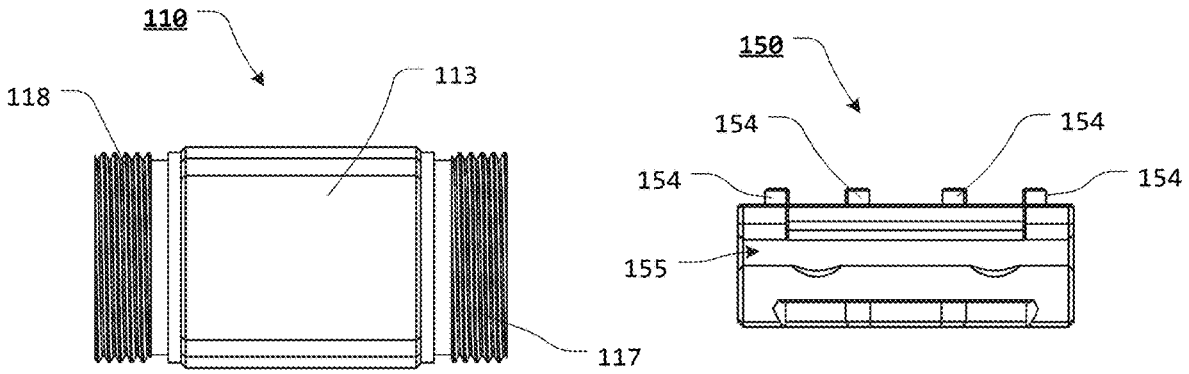
FIG. 8 illustrates a top view of certain exemplary components of an exemplary embodiment of an adjustable accessory mount, according to the present disclosure.
Figure 9:
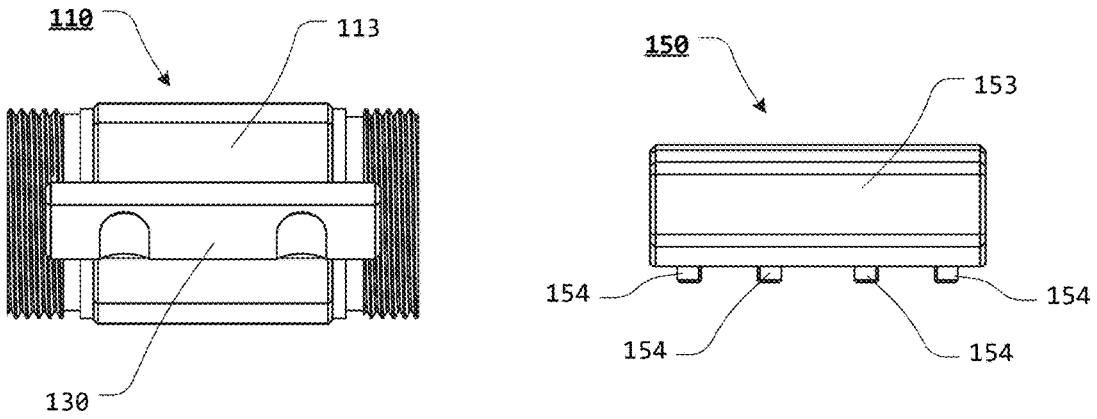
FIG. 9 illustrates a bottom view of certain exemplary components of an exemplary embodiment of an adjustable accessory mount, according to the present disclosure.
Figure 10:
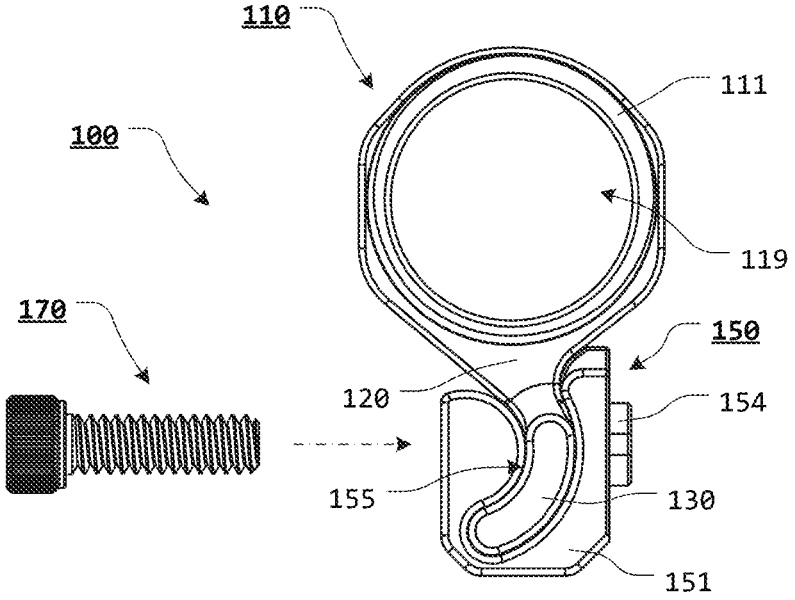
FIG. 10 illustrates a front view of certain exemplary components of an exemplary embodiment of an adjustable accessory mount, wherein the accessory element is positioned relative to the mount element, according to the present disclosure.
Figure 11:
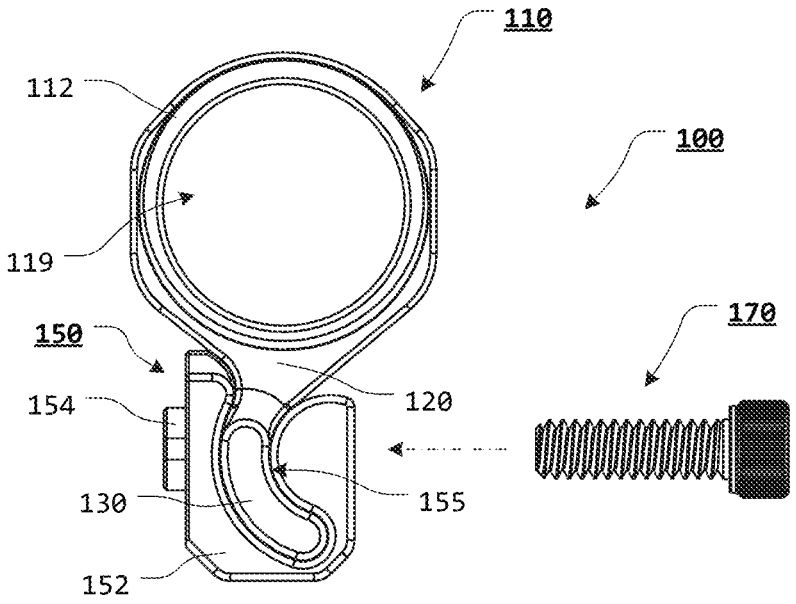
FIG. 11 illustrates a rear view of certain exemplary components of an exemplary embodiment of an adjustable accessory mount, wherein the accessory element is positioned relative to the mount element, according to the present disclosure.
Figure 12:
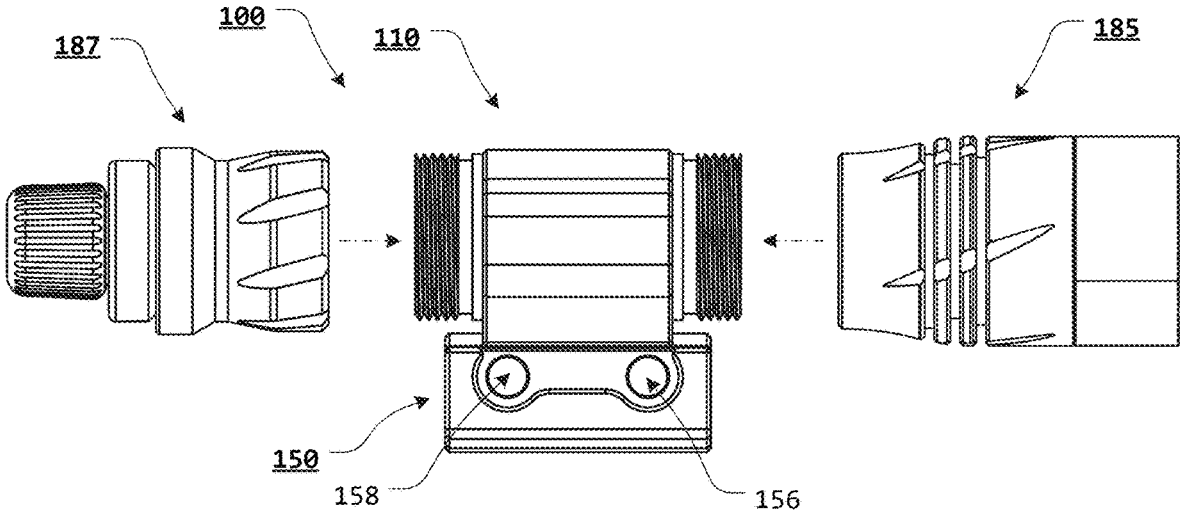
FIG. 12 illustrates a left side view of certain exemplary components of an exemplary embodiment of an adjustable accessory mount, wherein the accessory element is positioned relative to the mount element and exemplary accessory components are aligned with the accessory element, according to the present disclosure.
Figure 13:
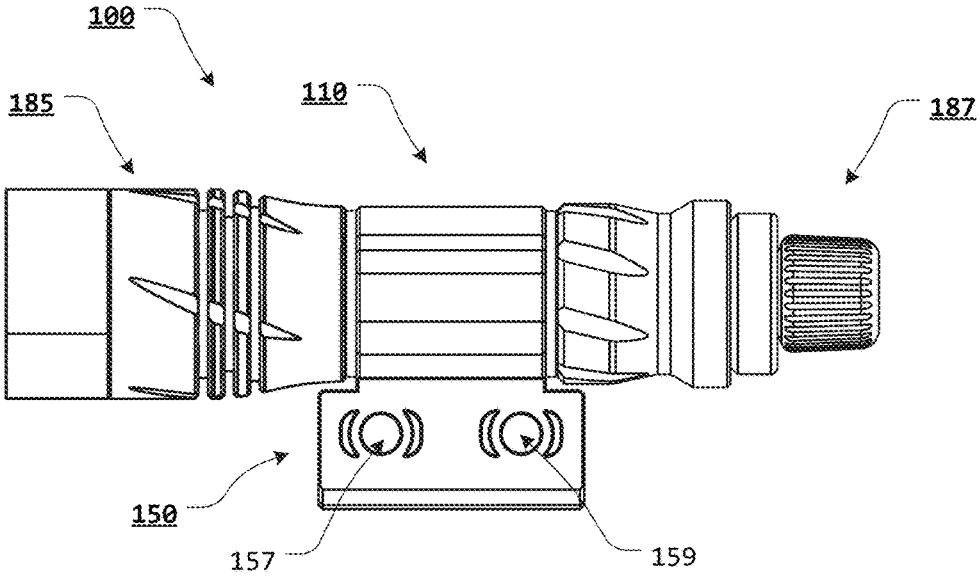
FIG. 13 illustrates a right side view of certain exemplary components of an exemplary embodiment of an adjustable accessory mount, wherein the accessory element is positioned relative to the mount element and exemplary accessory components are attached or coupled to the accessory element, according to the present disclosure.
Figure 14:
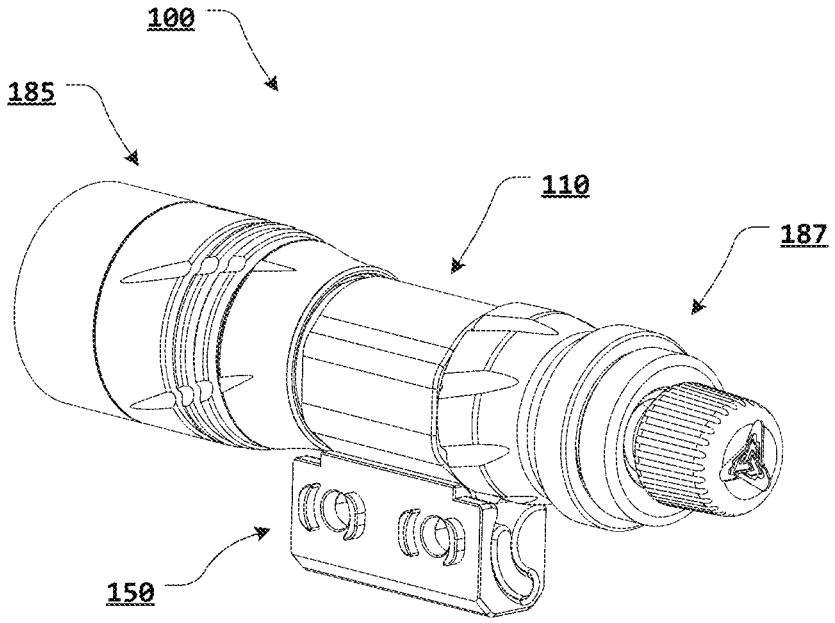
FIG. 14 illustrates an upper, rear, right, isometric view of certain exemplary components of an exemplary embodiment of an adjustable accessory mount, wherein the accessory element is positioned relative to the mount element and exemplary accessory components are attached or coupled to the accessory element, according to the present disclosure.
Figure 15:
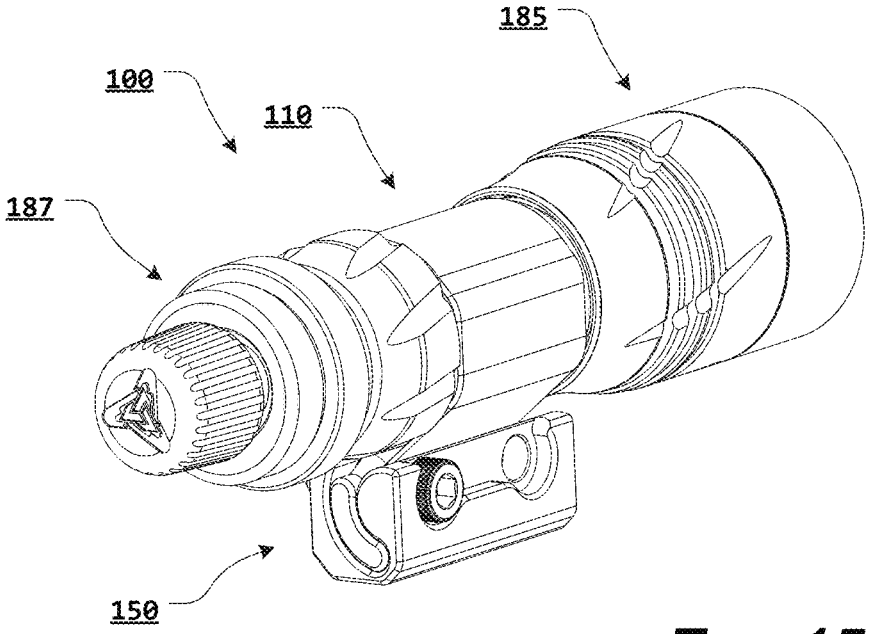
FIG. 15 illustrates an upper, rear, left, isometric view of certain exemplary components of an exemplary embodiment of an adjustable accessory mount, wherein the accessory element is positioned relative to the mount element and exemplary accessory components are attached or coupled to the accessory element, according to the present disclosure.
Figure 16:
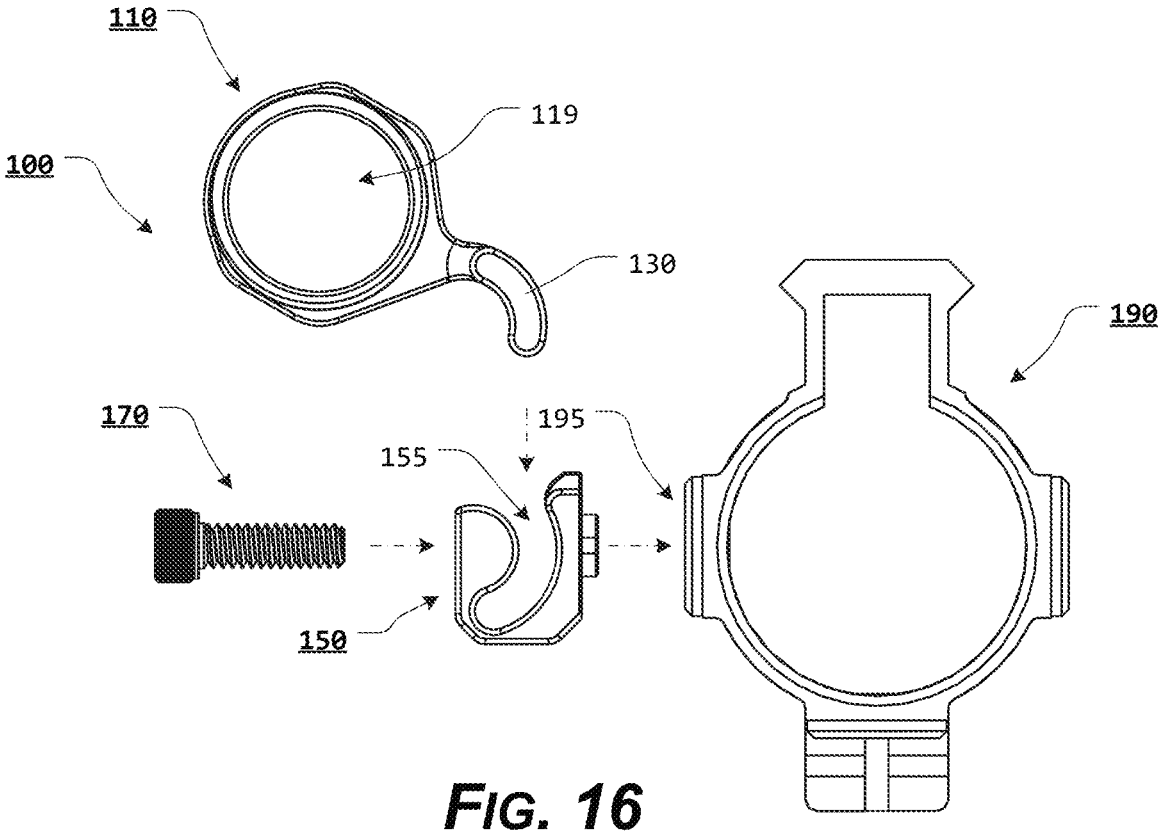
FIG. 16 illustrates a front view of certain exemplary components of an exemplary embodiment of an adjustable accessory mount, wherein the accessory element is positioned relative to the mount element and the mount element is aligned with an exemplary accessory rail, according to the present disclosure.
Figure 17:
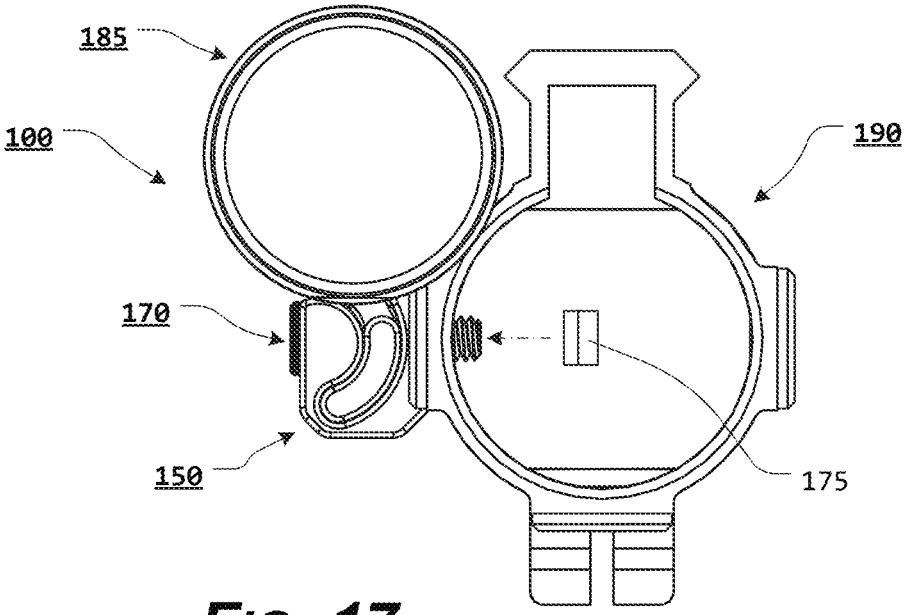
FIG. 17 illustrates a front view of certain exemplary components of an exemplary embodiment of an adjustable accessory mount, wherein the accessory element is positioned relative to the mount element and the mount element is attached for coupled to an exemplary accessory rail, according to the present disclosure.

The foregoing and other objectives, features, and advantages of the invention will be more readily understood upon consideration of the following description of the invention taken in conjunction with the accompanying drawings.

For simplicity and clarification, the design factors and operating principles of the adjustable accessory mount according to the present disclosure are explained with reference to various exemplary embodiments of adjustable accessory mount according to the present disclosure. The basic explanation of the design factors and operating principles of the adjustable accessory mount is applicable for the understanding, design, and operation of the adjustable accessory mount of the present disclosure. It should be appreciated that the adjustable accessory mount can be adapted to many applications where an adjustable accessory mount is necessary or desirable.

As used herein, the word "may" is meant to convey a permissive sense (i.e., meaning "having the potential to"), rather than a mandatory sense (i.e., meaning "must"). Unless stated otherwise, terms such as "first" and "second", "right" and "left", "top" and "bottom", "upper" and "lower", and "horizontal" and "vertical" are used to arbitrarily distinguish between the exemplary embodiments and/or elements such terms describe. Thus, these terms are not necessarily intended to indicate temporal or other prioritization of such exemplary embodiments and/or elements.

As used herein, and unless the context dictates otherwise, the term "coupled" is intended to include both direct coupling (in which two elements that are coupled to each other contact each other) and indirect coupling (in which at least one additional element is located between the two elements). The term coupled, as used herein, is defined as connected, although not necessarily directly, and not necessarily mechanically. The terms "a" and "an" are defined as one or more unless stated otherwise.

Throughout this application, the terms "comprise" (and any form of comprise, such as "comprises" and "comprising"), "have" (and any form of have, such as "has" and "having"), "include", (and any form of include, such as "includes" and "including") and "contain" (and any form of contain, such as "contains" and "containing") are used as open-ended linking verbs. It will be understood that these terms are meant to imply the inclusion of a stated element, integer, step, or group of elements, integers, or steps, but not the exclusion of any other element, integer, step, or group of elements, integers, or steps. As a result, a system, method, or apparatus that "comprises", "has", "includes", or "contains" one or more elements possesses those one or more elements but is not limited to possessing only those one or more elements. Similarly, a method or process that "comprises", "has", "includes" or "contains" one or more operations possesses those one or more operations but is not limited to possessing only those one or more operations.

It should also be appreciated that, for simplicity and clarification, certain embodiments of the present disclosure may be described using terms such as "front", "back", "rear", "right", "left", "upper", "lower", "outer", and/or "inner". However, it should be understood that these terms are merely used to aid in understanding of the present disclosure are not to be construed as limiting the systems, methods, devices, and/or apparatuses of the present disclosure. Additionally, it should be appreciated that, unless otherwise stated, the design factors and operating principles of the presently disclosed multidirectional explosive disruptor system may optionally be used in a "mirror image" assembly, wherein elements shown and/or described as being included in or on an upper or identified side portion may optionally be included in or on a lower or other side portion. Alternatively, certain of the elements that are shown and/or described as being included in or on a back portion may optionally be included in or on a front portion, or vice versa.

It should also be appreciated that the terms "adjustable accessory mount", "accessory element", "mount element", "attachment element", "first accessory component", and/or "second accessory component" are used for basic explanation and understanding of the operation of the systems, methods, and apparatuses of the present disclosure. Therefore, the terms "adjustable accessory mount", "accessory element", "mount element", "attachment element", "first accessory component", and/or "second accessory component" are not to be construed as limiting the systems, methods, and apparatuses of the present disclosure.

Furthermore, it should be appreciated that, for simplicity and clarification, the embodiments of the present disclosure will be shown and/or described with reference to the accessory element being utilized in connection with the first accessory component and a second accessory component in the form of a flashlight and a flashlight tail cap. However, it should be appreciated that this usage is merely exemplary and is not to be construed as limiting the present disclosure. Thus, the adjustable accessory mount of the present disclosure may be utilized as an accessory mount for any desired device or devices.

In the form of the present disclosure chosen for purposes of illustration, FIGS. 1-24 illustrate various views of certain exemplary components and/or configurations of the adjustable accessory mount 100 of the present disclosure.

In illustrative, non-limiting embodiment(s) of the present disclosure, as illustrated, for example, in FIGS. 1-24, the adjustable accessory mount 100 includes at least some of an accessory element 110, a mount element 150, and one or more fastening elements 170.

As illustrated, the accessory element 110 includes at least some of an accessory element body 113, an intermediate portion 120, and an arcuate attachment leg 130. The accessory element body 113 extends, along a longitudinal axis, $A_L$, of the accessory element 110, between a first terminal end 111 a second terminal end 112. In various exemplary embodiments, a coupling portion 117 is formed in, proximate, or extending from the first terminal end 111. Similarly, a coupling portion 118 is formed in, proximate, or extending from the second terminal end 112.

An interior recess 119 may optionally be formed partially into or through the accessory element body 113, extending between the first terminal end 111 and the second terminal end 112. Providing an interior recess 119 that extends between the first terminal end 111 and the second terminal end 112 creates an open first terminal end 111 and an open second terminal end 112.

In various exemplary embodiments, the coupling portion 117 and the coupling portion 118 each comprise externally threaded portions of the accessory element body 113. The coupling portion 117 and/or the coupling portion 118 allow accessory components to be attached or coupled to the first terminal end 111 and the second terminal end 112 of the accessory element body 113. The coupling portion 117 and/or the coupling portion 118 may also include or be formed of other coupling attachments or configurations, such as twist lock connectors, push-pull connectors, snap-fit connectors, cantilever snap-fit connectors, annular snap-fit connectors, quick disconnect couplings, or any mechanical connector or feature usable to join two or more parts together.

As illustrated in FIGS. 12-15, an exemplary first accessory component 185 in the form of a flashlight head assembly may optionally be threadedly attached or coupled (via, for example, interaction between external threads of the coupling portion 117 and corresponding internal threads of the flashlight head assembly) to the first terminal end 111 and an exemplary second accessory component 187 in the form of a flashlight tail assembly may optionally be threadedly attached for coupled (via, for example, interaction between external threads of the coupling portion 118 and corresponding internal threads of the flashlight tail assembly) to the second terminal end 112.

In this exemplary embodiment, batteries may be positioned within the interior recess 119 to allow the accessory element body 113 to act as a flashlight body with a flashlight head assembly flashlight tail assembly.

It should be appreciated that while the accessory element body 113 is illustrated as being used in conjunction with exemplary flashlight components, this is illustrative and not limiting. Thus, a variety of first accessory components 185 and second accessory components 187 may be utilized in conjunction with the accessory element body 113. Additionally, the accessory element body 113 may be formed such that only a first accessory component 185 is included or only a second accessory component 187 is included.

Furthermore, it should also be appreciated that while the accessory element body 113 is illustrated as having a substantially circular or cylindrical form or shape, this is illustrative and not limiting. Therefore, it should be understood that the accessory element body 113 may take any desired shape or form.

Additionally, the accessory element body 113 may be fully or partially formed or defined as a platform, mounting plate, or attachment rail, such as, for example, a portion of a Picatinny rail, a portion of a KeyMod or M-LOK rail, or the like.

An intermediate portion 120 extends from a lower portion of the accessory element body 113. The intermediate portion 120 may optionally extend tangentially, radially, or substantially parallel to or along the transverse axis, $A_T$, as a centerline extension from the accessory element body 113.

In various exemplary embodiments, an arcuate attachment leg 130 extends from the intermediate portion 120. Alternatively, the arcuate attachment leg 130 may extend directly from a lower portion of the accessory element body 113. The arcuate attachment leg 130 is formed of an arced, curved, bowed, bent, or semicircular portion extending directly or indirectly from the intermediate portion 120 or the accessory element body 113. Generally, the arcuate attachment leg 130 may be considered to be a convex curve (curving outward) or a concave curve (curving inward). In certain exemplary embodiments, the arc of the arcuate attachment leg 130 is approximately a quarter circle or 90°. Alternatively, the arc of the arcuate attachment leg 130 is between approximately 85° and 95°. In still other embodiments, the arc of the arcuate attachment leg 130 may optionally be between approximately 80° and 100°. It should be appreciated that the length of the arcuate attachment leg 130 and the degree of curvature or radius of the curve defining the arcuate attachment leg 130 are each a design choice, based, at least in part, on the degree of desired movement allowable between the accessory element body 113 and the mount element 150.

One or more attachment leg apertures 132 and 134 are formed through the arcuate attachment leg 130, substantially perpendicular to the transverse axis, $A_T$, of the accessory element 110. The attachment leg apertures 132 and 134 are generally formed of rounded rectangles or a rectangle with rounded or radiused ends. The attachment leg apertures 132 and 134 are formed through the curve of the arcuate attachment leg 130. In certain exemplary embodiments, the arc of each attachment leg aperture 132 and 134 is approximately a quarter circle or 90°. Alternatively, the arc of each attachment leg aperture 132 and 134 is between approximately 85° and 95°. In still other embodiments, the arc of each attachment leg aperture 132 and 134 may optionally be between approximately 80° and 100°. It should be appreciated that the length of each attachment leg aperture 132 and 134 is a design choice, based, at least in part, on the degree of desired movement allowable between the accessory element body 113 and the mount element 150.

The mount element 150 includes at least some of a mount element body 153 having an arcuate mount recess 155. The mount element 150 extends, along a longitudinal axis, $A_L$, of the mount element 150, between a first terminal end 151 a second terminal end 152.

An arcuate mount recess 155 is formed so as to extend into at least a portion of the mount element body 153. The arcuate mount recess 155 is formed of an arced, curved, bowed, bent, or semicircular recess extending from an upper portion of the mount element body 153 into at least a portion of the mount element body 153. Generally, the arcuate mount recess 155 may be considered to be a convex curve (curving outward) or a concave curve (curving inward). In certain exemplary embodiments, the arc of the arcuate mount recess 155 is approximately a quarter circle or 90°. Alternatively, the arc of the arcuate mount recess 155 is between approximately 85° and 95°. In still other embodiments, the arc of the arcuate mount recess 155 may optionally be between approximately 80° and 100°. It should be appreciated that the length or depth of the arcuate mount recess 155 and the degree of curvature or radius of the curve defining the arcuate mount recess 155 are each a design choice, based, at least in part, on the degree of desired movement allowable between the mount element body 153 and the mount element 150.

The arc or curve of the arcuate mount recess 155 is formed so as to matingly correspond to the arcuate attachment leg 130. All or at least a portion of the arcuate attachment leg 130 may be repeatably, slidably positioned within at least a portion of the arcuate mount recess 155. Thus, the arcuate attachment leg 130 in the arcuate mount recess 155 form a repeatably, sliding interlocking design relative to the longitudinal axis, $A_L$, and/or the transverse axis, $A_T$, of the accessory element 110 and/or the mount element 150.

One or more primary apertures 156 and 158 are formed through the mount element body 153 and one or more aligned, secondary apertures 157 and 159 are formed through the mount element body 153. The one or more primary apertures 156 and 158 are formed through a first side of the mount element body 153, so as to be formed through the first side of the mount element body 153 and the arcuate mount recess 155. The one or more secondary apertures 157 and 159 are formed through a second side of the mount element body 153, so as to be formed through the second side of the mount element body 153 and the arcuate mount recess 155.

Each primary aperture 156 and 158 is aligned, substantially perpendicular to the transverse axis, $A_T$, of the mount element 150, with a corresponding secondary aperture 157 and 159. In various exemplary embodiments, the sidewalls defining the primary apertures 156 and 158 in the secondary apertures 157 and 159 are at least somewhat smooth.

The primary apertures 156 or 158 are aligned with the secondary apertures 157 and 159 such that fastening elements 170, typically in the form of a bolt or machine screw, can be positioned through one of the primary apertures 156 or 158 and a corresponding one of the secondary apertures 157 or 159.

In various exemplary embodiments, M-LOK or other compatible alignment projections 154 extend outward from the second side of the mount element body 153 around at least portions of one or both of the secondary apertures 157 and 159. By including the one or more alignment projections 154, the mount element 150 may be more easily aligned with a portion of M-LOK or other similar rail portions, to assist in alignment and anti-rotation between the mount element 150 and an exemplary attachment portion 195 of a firearm handguard or other rail element 190.

During assembly and/or usage of the adjustable accessory mount 100, as illustrated, for example, in FIGS. 10-11 and 16-21, the arcuate attachment leg 130 of the accessory element 110 is positioned at least partially within a portion of the arcuate mount recess 155 of the mount element 150. As the arcuate attachment leg 130 is positioned within the arcuate mount recess 155, the accessory element 110 is rotationally inserted within the mount element 150. As the arcuate attachment leg 130 is positioned within the arcuate mount recess 155, the attachment leg apertures 132 and 134 are aligned with the primary apertures 156 and 158 and the secondary apertures 157 and 159.

Fastening elements 170 are then positioned through respective primary apertures 156 and 158, attachment leg apertures 132 and 134, and secondary apertures 157 and 159. Once appropriately positioned, at least a portion of each fastening element 170 extends from the second side of the mount element 150.

The extending portion of each of the fastening elements 170 is aligned with and extends at least partially through an appropriate aperture of the attachment portion 195 of the firearm handguard or other rail element 190. A nut 175, such as, for example, a M-LOK T-nut, is appropriately threadedly attached or coupled to each fastening element 170.

As the fastening elements 170 continue to engage the respective nuts 175 (i.e., via rotational movement and continued thread engagement of the fastening elements 170 relative to stationary nuts 175), the mount element 150 is initially drawn toward the attachment portion 195 of the rail element 190. As the fastening elements further engage the respective nuts 175, a sufficient force is applied to the first side of the mount element body 153 to at least partially compress the arcuate mount recess 155 against outer surfaces of the arcuate attachment leg 130. As the arcuate mount recess 155 is compressed against the arcuate attachment leg 130, movement of the arcuate attachment leg 130 relative to the arcuate mount recess 155 (and arcuate or other movement of the accessory element 110 relative to the mount element 150) is limited or restricted. If a sufficient amount of compressional force of the arcuate mount recess 155 relative to the arcuate attachment leg 130 is provided, movement of the accessory element 110 relative to the mount element 150 may be severely impeded.

Figure 18:
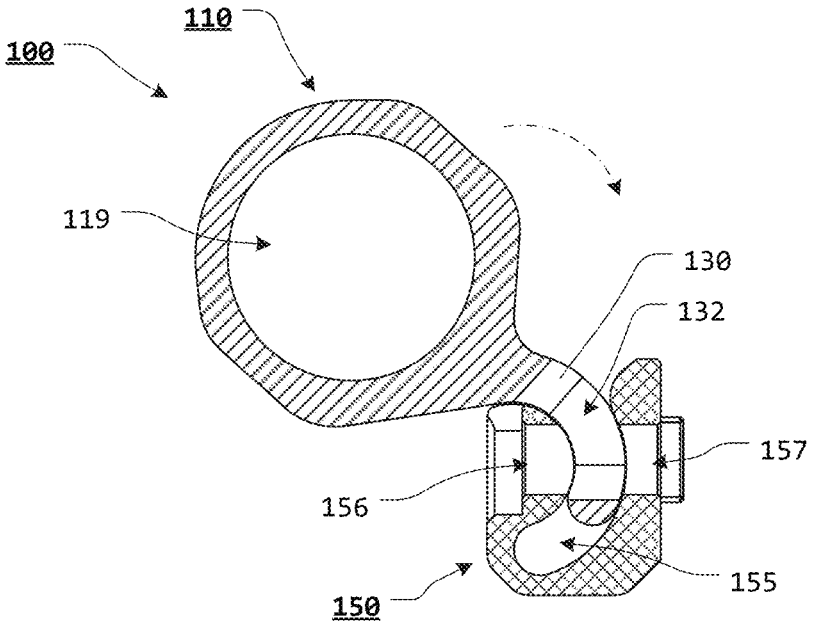
FIG. 18 illustrates a front, cross-sectional view of certain exemplary components of an exemplary embodiment of an adjustable accessory mount, wherein the accessory element is initially positioned relative to the mount element, according to the present disclosure.
Figure 19:
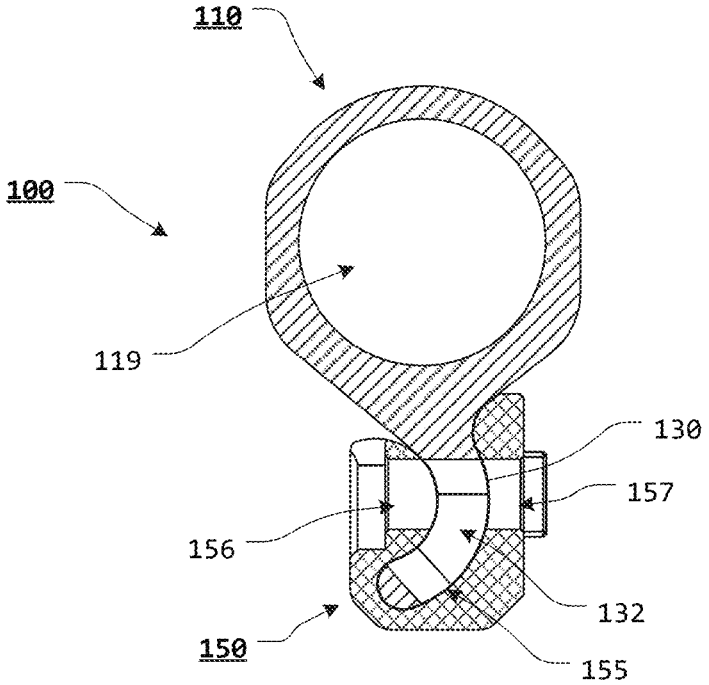
FIG. 19 illustrates a front, cross-sectional view of certain exemplary components of an exemplary embodiment of an adjustable accessory mount, wherein the accessory element is finally positioned relative to the mount element, according to the present disclosure.
Figure 20:
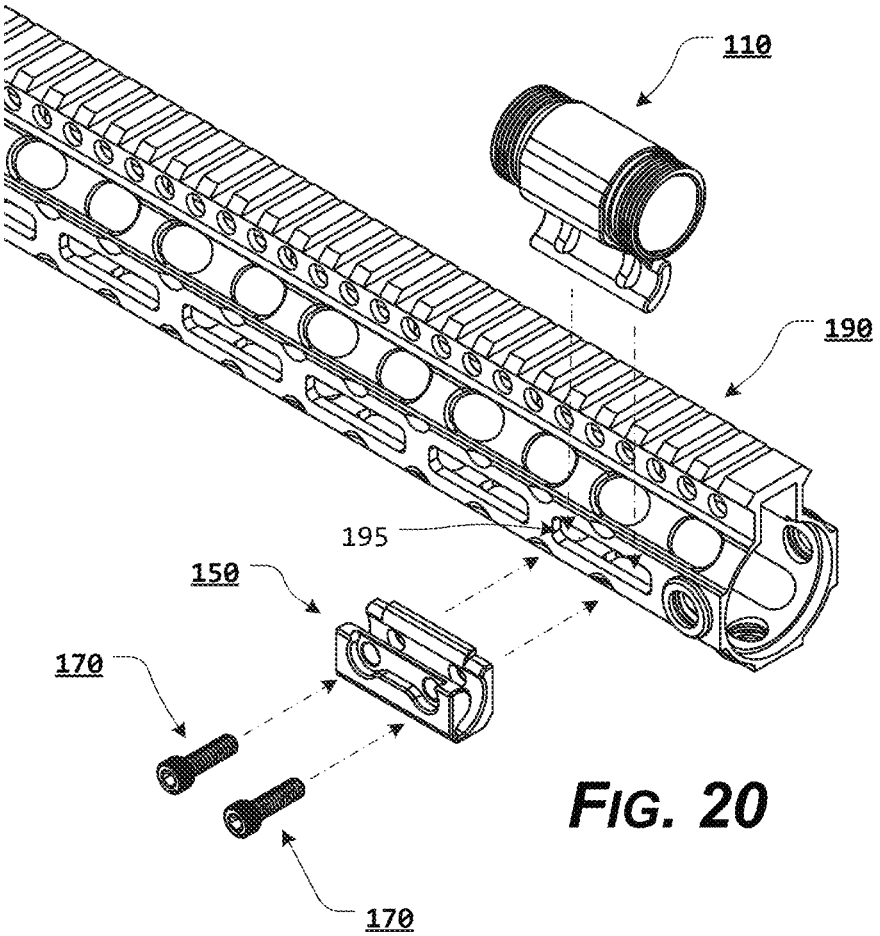
FIG. 20 illustrates an upper, front, left, isometric view of certain exemplary components of an exemplary embodiment of an adjustable accessory mount, wherein the accessory element is positioned relative to the mount element and the mount element is aligned with an exemplary accessory rail, according to the present disclosure.
Figure 21:
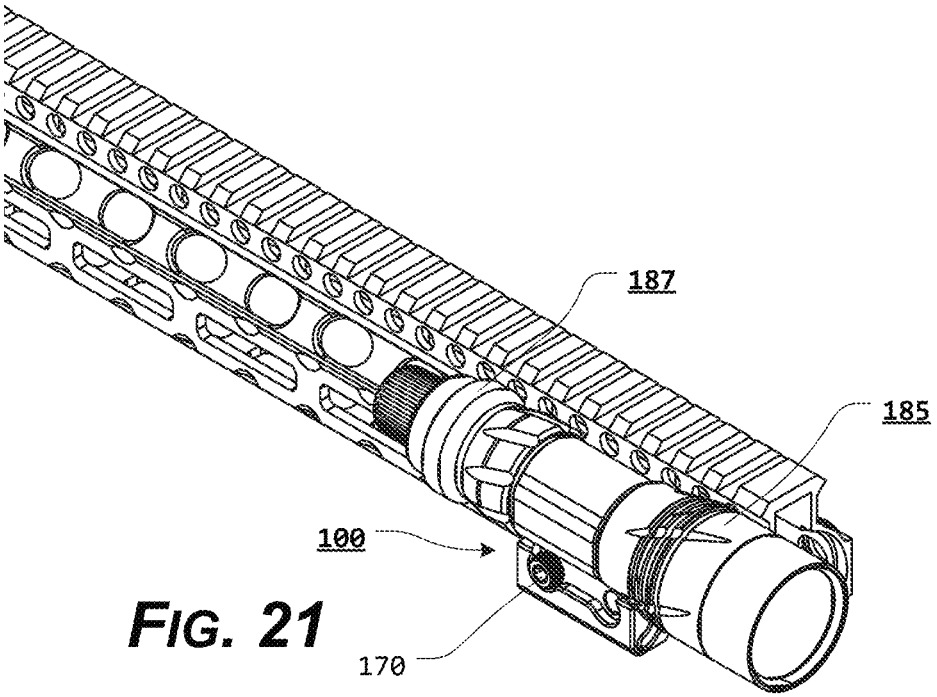
FIG. 21 illustrates an upper, front, left, isometric view of certain exemplary components of an exemplary embodiment of an adjustable accessory mount, wherein the adjustable accessory mount, including exemplary accessory components, is attached or coupled to an exemplary accessory rail, according to the present disclosure.

When a compressional force between the arcuate mount recess 155 in the arcuate attachment leg 130 is sufficiently released, the accessory element 110 is able to be arcuately rotated and extended or retracted relative to the mount element 150, as illustrated, for example, in FIGS. 18-19, to the extent allowed or defined by the interaction of the fastening elements 170 and the opposing, terminating end walls of the attachment leg apertures 132 and 134. As illustrated, for example, in FIG. 18, the accessory element 110 is in a fully extended position relative to the mount element 150. As illustrated, for example, in FIG. 19, the accessory element 110 is in a fully retracted position relative to the mount element 150.

Thus, within the confines defined by the fastening elements 170 and the attachment leg apertures 132 and 134, the accessory element 110 is infinitely positionable and repositionable relative to the mount element 150 between the fully extended position and a fully retracted position.

Figure 22:
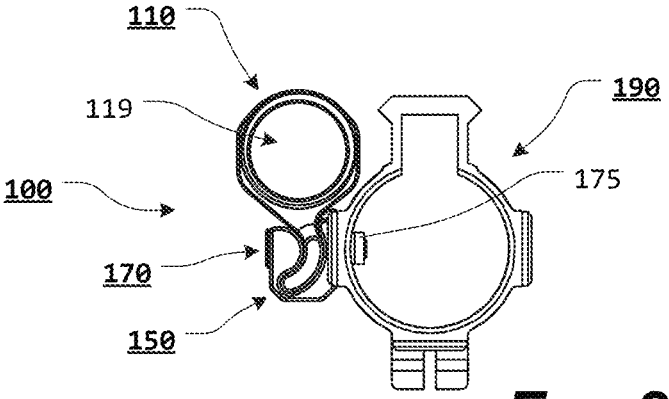
FIG. 22 illustrates a front view of certain exemplary components of an exemplary embodiment of an adjustable accessory mount, wherein the adjustable accessory mount is attached or coupled to an exemplary accessory rail, according to the present disclosure.
Figure 23:
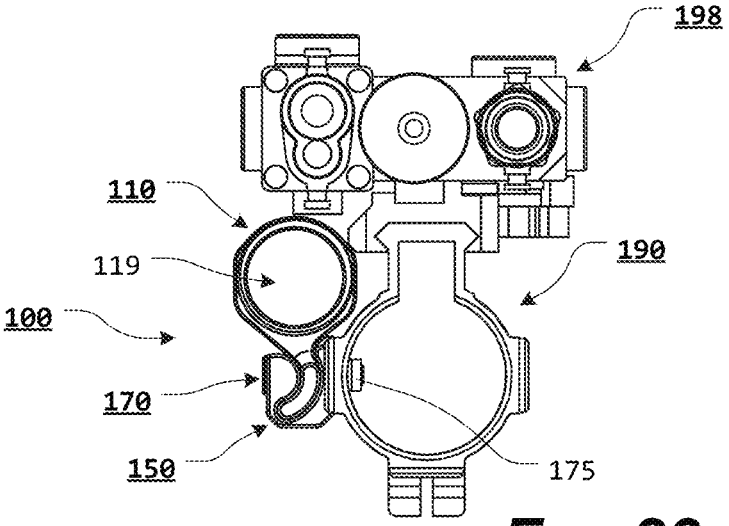
FIG. 23 illustrates a front view of certain exemplary components of an exemplary embodiment of an adjustable accessory mount, wherein the adjustable accessory mount is attached or coupled to an exemplary accessory rail, according to the present disclosure.
Figure 24A:
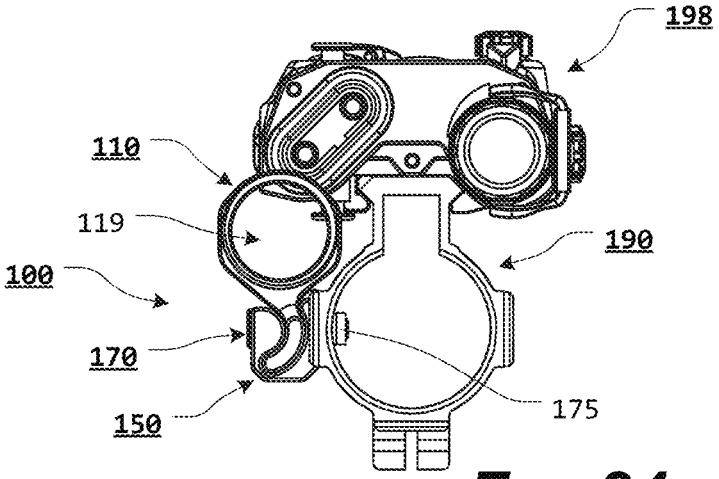
FIG. 24A illustrates a front view of certain exemplary components of an exemplary embodiment of an adjustable accessory mount, wherein the adjustable accessory mount is attached or coupled to an exemplary accessory rail and the accessory element is in a fully retracted position relative to the mount element, according to the present disclosure.

As illustrated, for example, in FIGS. 22-24, providing arcuate rotation of the accessory element 110 relative to the mount element 150 allows the accessory element 110 to be provided at a desired position or relative distance from another accessory device 198 also attached or coupled to the rail element 190 or another portion of an exemplary firearm or device. As illustrated, for example, in FIG. 22, the adjustable accessory mount 100 may optionally be the only element attached or coupled to the rail element 190, so that the accessory element 110 can be secured in the fully retracted position. As further illustrated, for example, in FIG. 23, the adjustable accessory mount 100 may optionally be included with an accessory device 198 (not illustrated) that is not undesirably obscured by a first accessory component 185 (or a second accessory component 187) or a portion of the accessory element 110, such that the accessory element 110 may be maintained in a fully retracted position. If, as illustrated, for example, in FIG. 24A, the adjustable accessory mount 100 is included with an accessory device 198 that may be at least partially obscured by a first accessory component 185 (or a second accessory component 187) (not illustrated) or a portion of the accessory element 110.

Figure 24B:
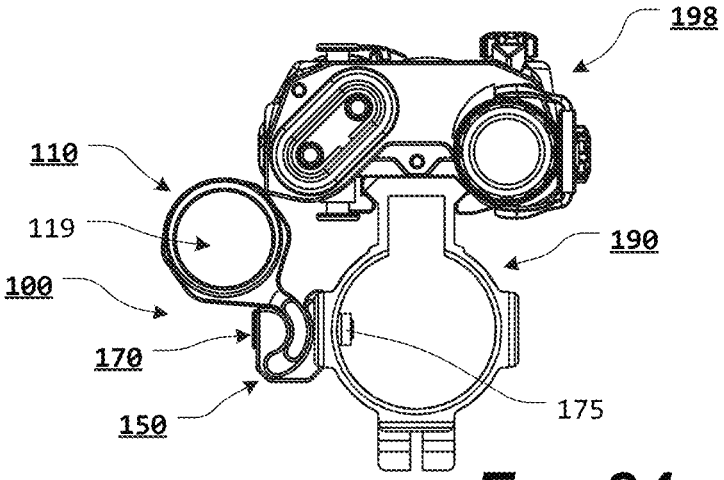
FIG. 24B illustrates a front view of certain exemplary components of an exemplary embodiment of an adjustable accessory mount, wherein the adjustable accessory mount is attached or coupled to an exemplary accessory rail and the accessory element is in a fully extended position relative to the mount element, according to the present disclosure.

As illustrated, for example, in FIG. 24B, the accessory element 110 may be secured in a fully extended position (or a desired position between a fully retracted position and a fully extended position) such that the accessory device 198 is not undesirably obscured by a first accessory component 185 (or a second accessory component 187) (not illustrated) or a portion of the accessory element 110.

For example, if the accessory device 198 is a laser designator and the adjustable accessory mount 100 includes a first accessory component 185 in the form of a flashlight head, the accessory element 110 may be arcuately rotated and extended or retracted relative to the mount element 150 (to any desired position between the fully retracted position and the fully extended position) such that the flashlight head does not obscure or interfere with a laser or other visible or nonvisible light emitted from the laser designator.

By providing arcuate, rotational movement, the accessory element 110 (and any first accessory component 185, second accessory component 187, or other component) can be repositioned, while maintaining a close proximity with and compact relationship to the rail element 190.

It should also be appreciated that a more detailed explanation of the specific dimensions of certain components of the adjustable accessory mount 100, instructions regarding how to install the adjustable accessory mount 100, additional methods for using the adjustable accessory mount 100, and certain other items and/or techniques necessary for the implementation and/or operation of the various exemplary embodiments of the present disclosure are not provided herein because such background information will be known to one of ordinary skill in the art. Therefore, it is believed that the level of description provided herein is sufficient to enable one of ordinary skill in the art to understand and practice the systems, methods, and apparatuses of the presentation, as described.

It should be appreciated that the adjustable accessory mount of the present disclosure is not limited to the embodiment illustrated and described as the adjustable accessory mount 100.

While the present disclosure has been described in conjunction with the exemplary embodiments outlined above, the foregoing description of exemplary embodiments of the present disclosure, as set forth above, are intended to be illustrative, not limiting and the fundamental disclosure should not be considered to be necessarily so constrained. It is evident that the present disclosure is not limited to the particular variation set forth and many alternatives, adaptations modifications, and/or variations will be apparent to those skilled in the art.

Furthermore, where a range of values is provided, it is understood that every intervening value, between the upper and lower limit of that range and any other stated or intervening value in that stated range is encompassed within the present disclosure. The upper and lower limits of these smaller ranges may independently be included in the smaller ranges and is also encompassed within the present disclosure, subject to any specifically excluded limit in the stated range. Where the stated range includes one or both of the limits, ranges excluding either or both of those included limits are also included in the present disclosure.

It is to be understood that the phraseology of terminology employed herein is for the purpose of description and not of limitation. Unless defined otherwise, all technical and scientific terms used herein have the same meaning as commonly understood by one of ordinary skill in the art to which the present disclosure belongs.

In addition, it is contemplated that any optional feature of the inventive variations described herein may be set forth and claimed independently, or in combination with any one or more of the features described herein. Accordingly, the foregoing description of exemplary embodiments will reveal the general nature of the present disclosure, such that others may, by applying current knowledge, change, vary, modify, and/or adapt these exemplary, non-limiting embodiments for various applications without departing from the spirit and scope of the present disclosure and elements or methods similar or equivalent to those described herein can be used in practicing the present disclosure. Any and all such changes, variations, modifications, and/or adaptations should and are intended to be comprehended within the meaning and range of equivalents of the disclosed exemplary embodiments and may be substituted without departing from the true spirit and scope of the present disclosure.

Also, it is noted that as used herein and in the appended claims, the singular forms "a", "and", "said", and "the" include plural referents unless the context clearly dictates otherwise. Conversely, it is contemplated that the claims may be so-drafted to require singular elements or exclude any optional element indicated to be so here in the text or drawings. This statement is intended to serve as antecedent basis for use of such exclusive terminology as "solely", "only", and the like in connection with the recitation of claim elements or the use of a "negative" claim limitation(s).

What is claimed is:

1. An adjustable accessory mount, comprising:

an accessory element having an accessory element body, an intermediate portion extending from a lower portion of said accessory element body, and an arcuate attachment leg extending from said intermediate portion, wherein said arcuate attachment leg is formed of an arced, curved, bowed, bent, or semicircular portion, and wherein one or more attachment leg apertures are formed through said arcuate attachment leg; and a mount element having a mount element body, wherein an arcuate mount recess is formed so as to extend into at least a portion of said mount element body, wherein said arcuate mount recess is formed of an arced, curved, bowed, bent, or semicircular recess extending from an upper portion of said mount element body, wherein said arcuate mount recess is formed so as to matingly correspond to said arcuate attachment leg such that at least a portion of said arcuate attachment leg May be repeatably, slidably positioned within at least a portion of said arcuate mount recess, wherein one or more primary apertures are formed through said mount element body and one or more secondary apertures are formed through said mount element body, wherein each of said one or more primary apertures is formed through a first side of said mount element body to extend to said arcuate mount recess, wherein each of said one or more secondary apertures is formed through a second side of said mount element body to extend to said arcuate mount recess, wherein each of said one or more primary apertures is aligned with a corresponding one of said one or more secondary apertures, wherein said arcuate attachment leg of said accessory element is positionable at least partially within a portion of said arcuate mount recess of said mount element such that each of said attachment leg apertures is aligned between a corresponding one of said primary apertures and one of said secondary apertures, wherein a discrete fastening element is positionable at least partially through one of said primary apertures, a corresponding one of said attachment leg apertures, and a corresponding one of said secondary apertures, and wherein if a compressional force is applied to said first side of said mount element body and said second side of said mount element body, proximate said arcuate mount recess, one or more portions of said arcuate mount recess are at least partially compressed against one or more outer surfaces of said arcuate attachment leg to limit or restrict movement of said arcuate attachment leg relative to said arcuate mount recess.

2. The adjustable accessory mount of claim 1, wherein said accessory element body extends, along a longitudinal axis of said accessory element, between a first terminal end of said accessory element body and a second terminal end of said accessory element body.

3. The adjustable accessory mount of claim 1, wherein a coupling portion is formed in a portion of said first terminal end of said accessory element body and a coupling portion is formed in a portion of said second terminal end of said accessory element body.

4. The adjustable accessory mount of claim 3, wherein said coupling portion of said first terminal end and said coupling portion of said second terminal end each comprise externally threaded portions or coupling attachments.

5. The adjustable accessory mount of claim 3, wherein a first accessory component in said form of a flashlight head assembly is attached or coupled to said first terminal end of said accessory element body and a second accessory component in said form of a flashlight tail assembly is attached for coupled to said second terminal end of said accessory element body.

6. The adjustable accessory mount of claim 1, wherein an interior recess is formed partially into or through said accessory element body, extending between said first terminal end of said accessory element body and said second terminal end of said accessory element body.

7. The adjustable accessory mount of claim 1, wherein said intermediate portion extends tangentially, radially, or as a centerline extension from said accessory element body.

8. The adjustable accessory mount of claim 1, wherein said arcuate attachment leg is at least partially defined by a convex curve or a concave curve.

9. The adjustable accessory mount of claim 1, wherein an arc of said arcuate attachment leg is approximately 90°.

10. The adjustable accessory mount of claim 1, wherein an arc of said arcuate attachment leg is between approximately 85° and 95°.

11. The adjustable accessory mount of claim 1, wherein an arc of said arcuate attachment leg is between approximately 80° and 100°.

12. The adjustable accessory mount of claim 1, wherein said attachment leg apertures extend substantially perpendicular to a transverse axis of said accessory element, and wherein said attachment leg apertures are formed of rectangles with rounded or radiused ends.

13. The adjustable accessory mount of claim 1, wherein said arcuate mount recess extends between a first terminal end of said mount element a second terminal end of said mount element.

14. The adjustable accessory mount of claim 1, wherein said arcuate mount recess is at least partially defined by a convex curve or a concave curve.

15. The adjustable accessory mount of claim 1, wherein an arc of said arcuate mount recess is between approximately 80° and 100°.

16. The adjustable accessory mount of claim 1, wherein one or more alignment projections extend outward from said second side of said mount element body around at least one or more portions of each of said secondary apertures.

17. An adjustable accessory mount, comprising:

an accessory element having an accessory element body, an intermediate portion extending from a lower portion of said accessory element body, and an arcuate attachment leg extending from said intermediate portion, and wherein one or more attachment leg apertures are formed through said arcuate attachment leg; and a mount element having a mount element body, wherein an arcuate mount recess is formed so as to extend into at least a portion of said mount element body, wherein said arcuate mount recess is formed so as to matingly correspond to said arcuate attachment leg such that at least a portion of said arcuate attachment leg may be repeatably, slidably positioned within at least a portion of said arcuate mount recess, wherein one or more primary apertures are formed through said mount element body and one or more secondary apertures are formed through said mount element body, wherein each of said one or more primary apertures is formed through a first side of said mount element body to extend to said arcuate mount recess, wherein each of said one or more secondary apertures is formed through a second side of said mount element body to extend to said arcuate mount recess, wherein each of said one or more primary apertures is aligned with a corresponding one of said one or more secondary apertures, wherein said arcuate attachment leg of said accessory element is positionable at least partially within a portion of said arcuate mount recess of said mount element such that each of said attachment leg apertures is aligned between a corresponding one of said primary apertures and one of said secondary apertures, and wherein if a compressional force is applied to said first side of said mount element body and said second side of said mount element body, proximate said arcuate mount recess, one or more portions of said arcuate mount recess are at least partially compressed against one or more outer surfaces of said arcuate attachment leg to limit or restrict movement of said arcuate attachment leg relative to said arcuate mount recess.

18. The adjustable accessory mount of claim 17, wherein said arcuate attachment leg is formed of an arced, curved, bowed, bent, or semicircular portion.

19. The adjustable accessory mount of claim 17, wherein said arcuate mount recess is formed of an arced, curved, bowed, bent, or semicircular recess extending from an upper portion of said mount element body.

20. An adjustable accessory mount, comprising:

an accessory element having an accessory element body, an arcuate attachment leg extending from a portion of said accessory element body, and wherein one or more attachment leg apertures are formed through said arcuate attachment leg; and a mount element having a mount element body, wherein an arcuate mount recess is formed so as to extend into at least a portion of said mount element body, wherein said arcuate mount recess is formed so as to matingly correspond to said arcuate attachment leg such that at least a portion of said arcuate attachment leg may be repeatably, slidably positioned within at least a portion of said arcuate mount recess, wherein one or more primary apertures are formed through said mount element body and one or more secondary apertures are formed through said mount element body, wherein each of said one or more primary apertures is formed through a first side of said mount element body to extend to said arcuate mount recess, wherein each of said one or more secondary apertures is formed through a second side of said mount element body to extend to said arcuate mount recess, wherein each of said one or more primary apertures is aligned with a corresponding one of said one or more secondary apertures, wherein said arcuate attachment leg of said accessory element is positionable at least partially within a portion of said arcuate mount recess of said mount element such that each of said attachment leg apertures is aligned between a corresponding one of said primary apertures and one of said secondary apertures, and wherein if a compressional force is applied to said first side of said mount element body and said second side of said mount element body, proximate said arcuate mount recess, one or more portions of said arcuate mount recess are at least partially compressed against one or more outer surfaces of said arcuate attachment leg to limit or restrict movement of said arcuate attachment leg relative to said arcuate mount recess.

* * * * *